US006202363B1

(12) United States Patent
Chang

(10) Patent No.: US 6,202,363 B1
(45) Date of Patent: Mar. 20, 2001

(54) SHIELDING CANOPY

(76) Inventor: Chao-Jen Chang, No. 5-2, Lane 138, Sec. 2, Chungshan N. Rd., Taipei (TW)

( * ) Notice: Subject to any disclaimer, the term of this patent is extended or adjusted under 35 U.S.C. 154(b) by 0 days.

(21) Appl. No.: 09/324,174

(22) Filed: Jun. 3, 1999

(30) Foreign Application Priority Data

Jun. 8, 1998 (TW) ..... 87209044

(51) Int. Cl.[7] ..... E04B 7/16

(52) U.S. Cl. ..... 52/75; 52/74; 52/473; 52/200; 160/22; 160/61

(58) Field of Search ..... 52/74, 75, 73, 52/200, 473, 90.1; 135/908; 160/62, 79, 82, 132, 218, 220, 22, 29, 59, 61; 49/73.1, 74.1

(56) References Cited

U.S. PATENT DOCUMENTS 1,797,311 * 3/1931 Young ..... 49/109
3,919,814 * 11/1975 Beretta et al. ..... 52/90
5,306,210 * 4/1994 Smit ..... 454/250

* cited by examiner

*Primary Examiner*—Carl D. Friedman
*Assistant Examiner*—Jennifer I. Thissell
(74) *Attorney, Agent, or Firm*—Rosenberg, Klein & Lee

(57) ABSTRACT

A shielding canopy includes a fixture base mounted to a wall. A plurality of swiveling devices mounted to and equally-spaced along the fixture base. Each swiveling device rotatably supports a rotating shaft to which a panel of a predetermined width is fixed. The width of the panels substantially corresponds to a distance between adjacent swiveling devices whereby when the panels are rotated from a collapsed position where the panels substantially overlap each other to an expanded position, edges of the panels engage with each other whereby the panels together form a continuous canopy. A driving rod, actuated manually or by power, is movably supported in the fixture base. A plurality of connecting arms are pivoted to the driving rod and have free ends fixed to the rotating shafts thereby when the driving rod is moved, the panels are rotated.

14 Claims, 8 Drawing Sheets

SHIELDING CANOPY

FIELD OF THE INVENTION

The present invention generally relates to a shielding canopy, and in particular to a collapsible shielding canopy.

BACKGROUND OF THE INVENTION

A shielding canopy is usually mounted above a door or a window for shielding sun light and rain. Conventionally, a shielding canopy is fixed and may not be collapsed whereby once the shielding canopy is mounted to for example a wall, it cannot be removed easily and it occupies a great amount of space.

A collapsible shielding canopy is also available in the market. The collapsible shielding canopy allows a user to selectively collapse/expand the canopy by means of a complicated mechanical system. The conventional collapsible shielding canopy still occupies a great amount of space after being collapsed.

Thus, it is desired to have a collapsible shielding canopy for overcoming the disadvantages of the conventional shielding canopies.

SUMMARY OF THE INVENTION

Accordingly, an object of the present invention is to provide a collapsible shielding canopy having a simple structure and operable by means of a simple mechanism.

Another object of the present invention is to provide a collapsible shielding canopy that occupies a small amount of space after being collapsed.

A further object of the present invention is to provide a collapsible shielding canopy that is easy to operate.

To achieve the above objects, in accordance with the present invention, there is provided a shielding canopy comprising a fixture base mounted to a wall. A plurality of swiveling devices mounted to and equally-spaced along the fixture base. Each swiveling device rotatably supports a rotating shaft to which a panel of a predetermined width is fixed. The width of the panels substantially corresponds to a distance between adjacent swiveling devices whereby when the panels are rotated from a collapsed position where the panels substantially overlap each other to an expanded position, edges of the panels engage with each other whereby the panels together form a continuous canopy. A driving rod, actuated manually or by power, is movably supported in the fixture base. A plurality of connecting arms are pivoted to the driving rod and have free ends fixed to the rotating shafts thereby when the driving rod is moved, the panels are rotated.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENT

Figure 1:
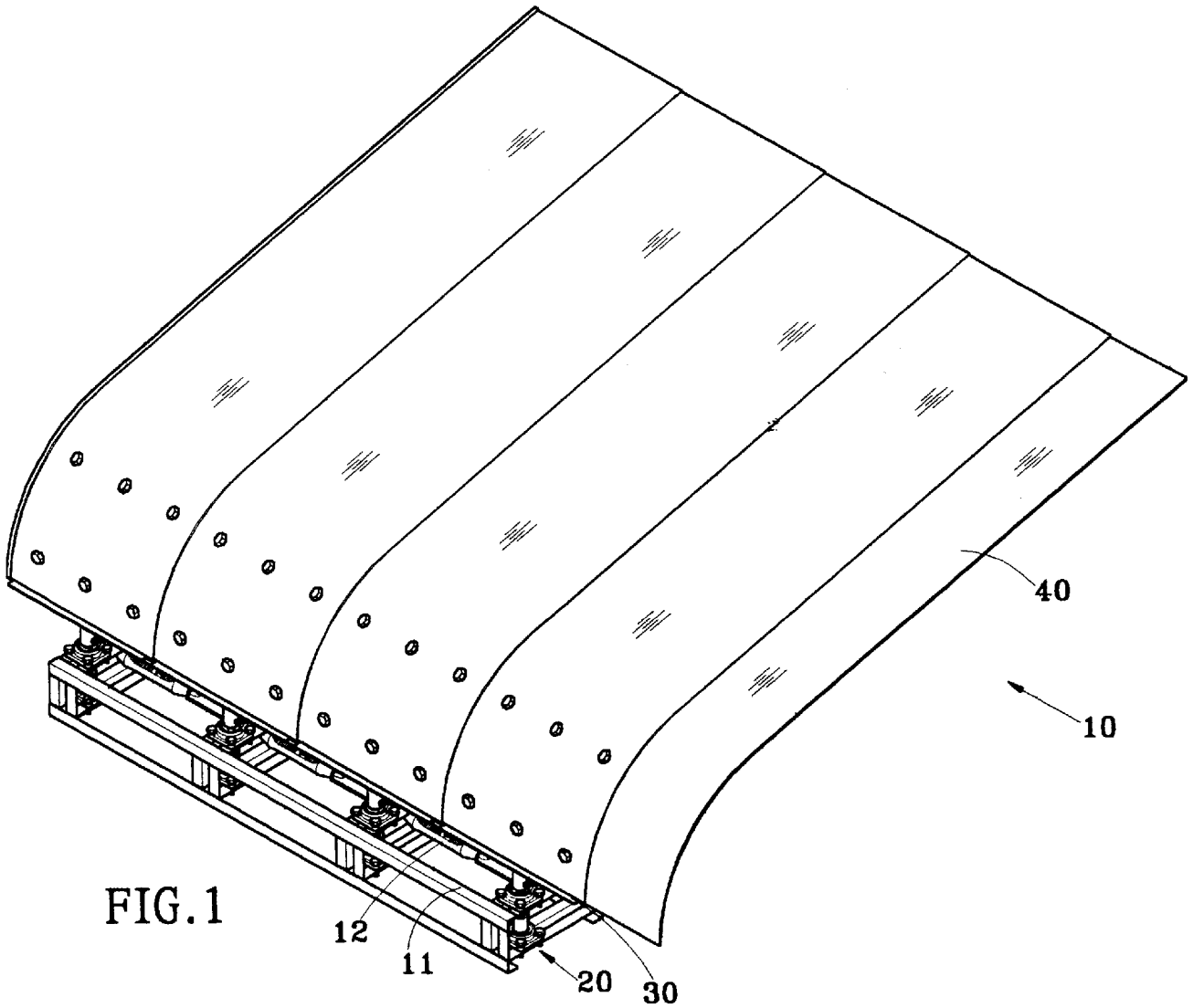
FIG. 1 is a perspective view of a shielding canopy constructed in accordance with the present invention at a fully expanded position.

With reference to the drawings and in particular to FIG. 1, wherein a shielding canopy constructed in accordance with the present invention, generally designated by reference numeral 10, is shown at a fully expanded position, the shielding canopy 10 comprises a fixture base 11 adapted to be mounted to for example a wall 13 (see FIG. 8) and a plurality of panels 40 rotatably supported on the fixture base 11 by means of corresponding swiveling devices 20 that are fixed to the fixture base 11 and spaced from each other along the fixture base 11. Preferably, the swiveling devices 20 are equally spaced from each other. Each panel 40 is mounted to a support plate 30 which is rotatable by the corresponding swiveling device 20.

Figure 2:
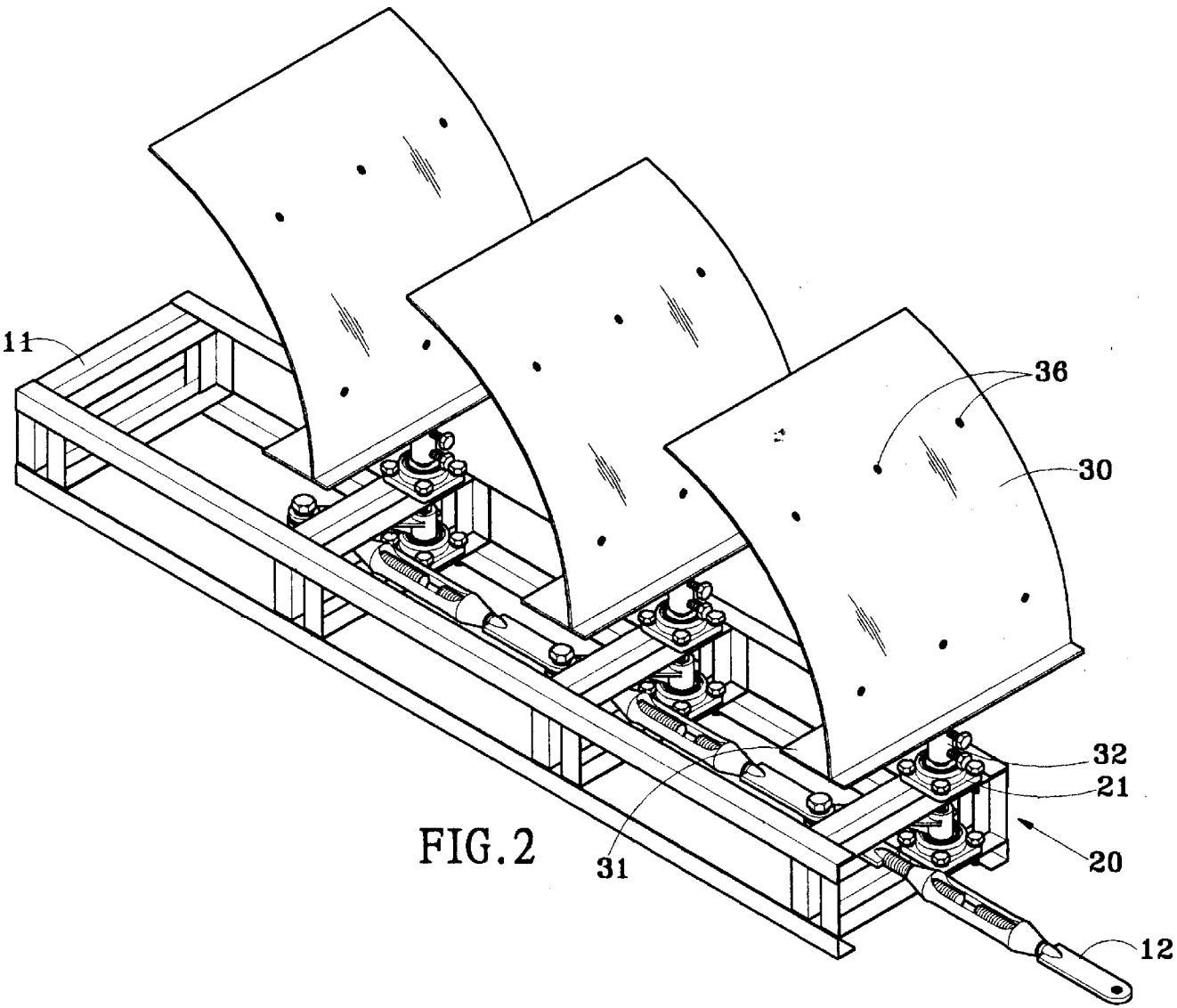
FIG. 2 is a perspective view of the shielding canopy at a collapsed position with shielding panels thereof removed.
Figure 3:
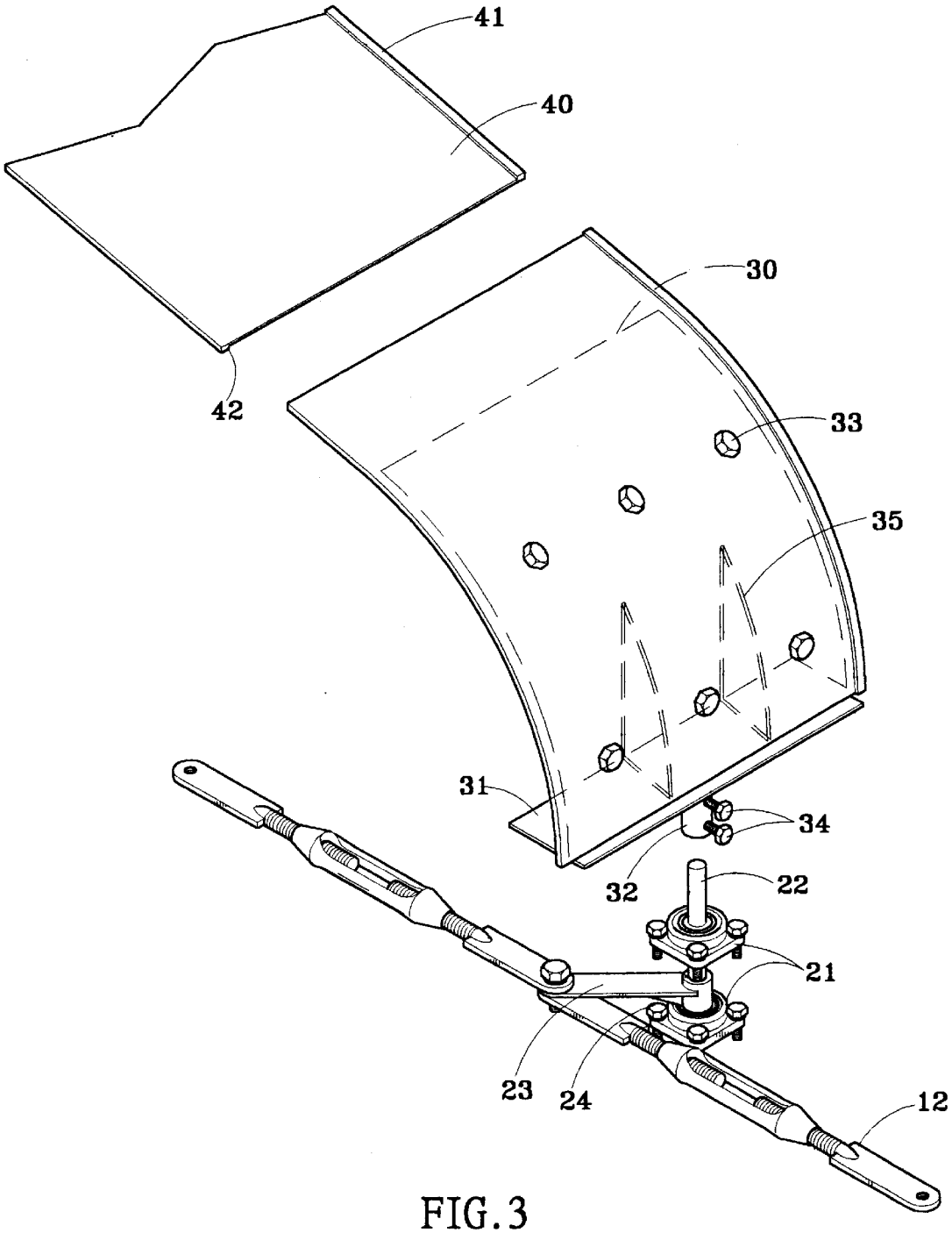
FIG. 3 a fragmentary view of a shielding panel and a driving rod of the shielding canopy of the present invention.

Referring also to FIGS. 2 and 3, each swiveling device 20 comprises a pair of aligned shaft bearing elements 21 fixed to the fixture base 11 by means of bolts 24. The bearing elements 21 may comprise regular bearing or bushing. Preferably, the fixture base 11 is a hollow frame with the bearing elements 21 mounted to top and bottom sides thereof. A rotating shaft 22 extends through and is rotatably supported by the bearing elements 21 of each swiveling device 20. The support plate 30 comprises a base section 31 to which a socket 32 is mounted for receiving a free end of the rotating shaft 22. Bolts 34 are mounted to the socket 32 for securing the support plate 30 to the rotating shaft 22 whereby the panel 40 is rotatable in unison with the rotataing shaft 22.

Figure 8:
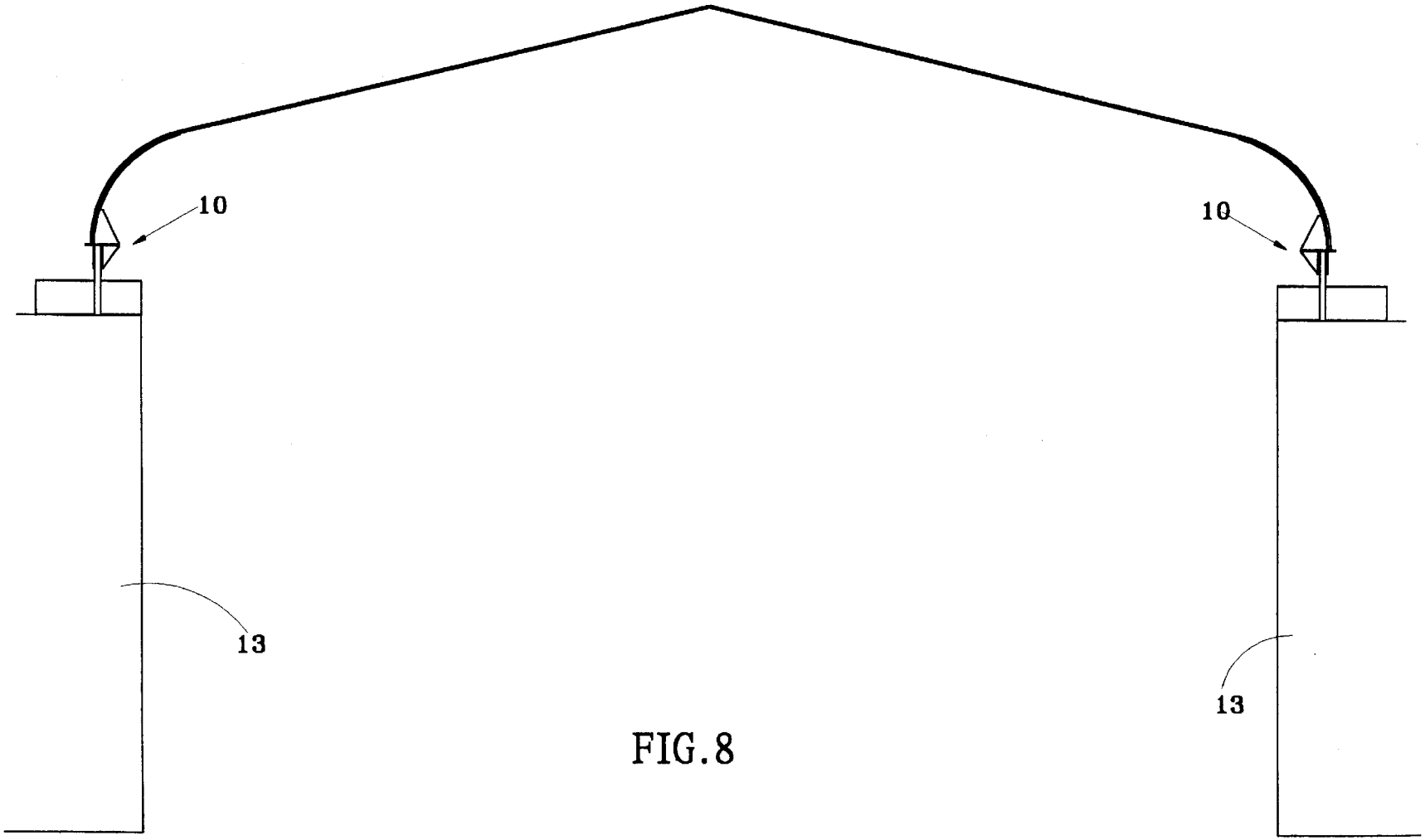
FIG. 8 is a side elevational view showing an application of the present invention wherein two shielding canopies of the present invention are mounted to opposing walls of two spaced buildings for forming a top shield of a space between the buildings.

The support plate 30 may has any desired configuration for supporting the corresponding panel 40 thereon. In the embodiment illustrated, the support plate 30 has an arcuate configuration on which holes 36 (FIG. 2) are defined. Bolts 33 are received in the holes 36 for securing the panel 40 to the support plate 30. Preferably, reinforcing brackets 35 are formed between the support plate 30 and the base section 31 thereof As shown in FIG. 8, the arcuate configuration of the support plate 30 leads to an inclined arrangement of the panel 40 whereby two shielding canopies 10 of the present invention may be mounted to opposing walls 31 of two spaced buildings and the panels 40 thereof may meet each other at a middle position therebetween forming a ridge when the shielding canopies 10 are fully expanded thereby providing a shield for the space between the buildings.

A driving member 12, such as an elongate rod, is movably supported in the fixture base 11. A plurality of connecting arms 23 are pivoted to the driving rod 12. Each connecting arm 23 has a free end fixed to the corresponding rotating shaft 22 between the corresponding bearing elements 21 whereby when the driving rod 12 is moved axially, the rotating shafts 22 are rotated by means of the connecting arms 23 and thus moving the panels 40 between the expanded position shown in FIG. 1 and a collapsed position shown in FIG. 2.

Preferably, the driving rod 12 is made of a rigid material for being moved manually. Alternatively, a motor and an associated transmission system may be coupled to the driving rod 12 for moving the driving rod 12. The driving rod 12 may be replaced by flexible rope or chain which forms an endless loop for being driven manually or by power to move the connecting arms 23.

The panels 40 may be made from rigid plates, such as metal plates, rigid plastic plates, for example acrylic plates, wooden plates. An alternative panel may be formed by attaching a flexible sheet to a rigid frame for reducing the overall weight thereof.

Figure 7:
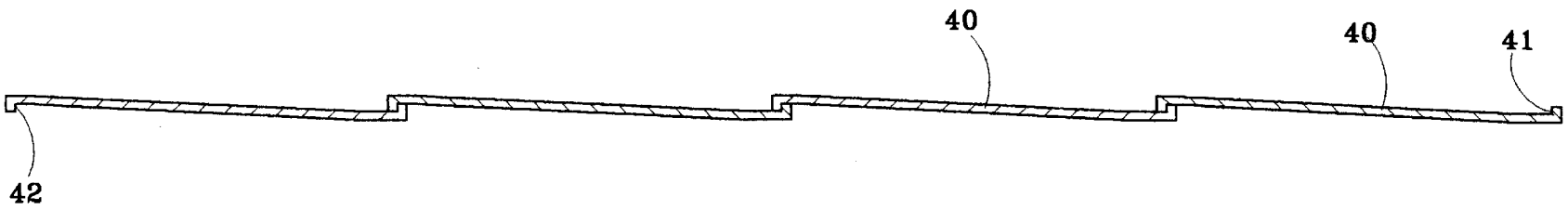
FIG. 7 is an end view of the shielding panels engaging with each other at the fully expanded position.

The spacing between the swiveling devices 20 and the width of the panels 40 are such that when the shielding canopy 10 is fully expanded, corresponding edges of adjacent panels 40 engage each other to form a continuous canopy. In this respect, bent flanges 41, 42 are formed on opposite edges of each panel 40. The flanges 41, 42 are bent in opposite directions (above and below the panel 40) whereby when the shielding canopy 10 is fully expanded, the flanges 41, 42 of adjacent panels 40 engage with each other, as shown in FIG. 7, which effectively prevents rain from penetrating the shielding canopy 10.

Figure 4:
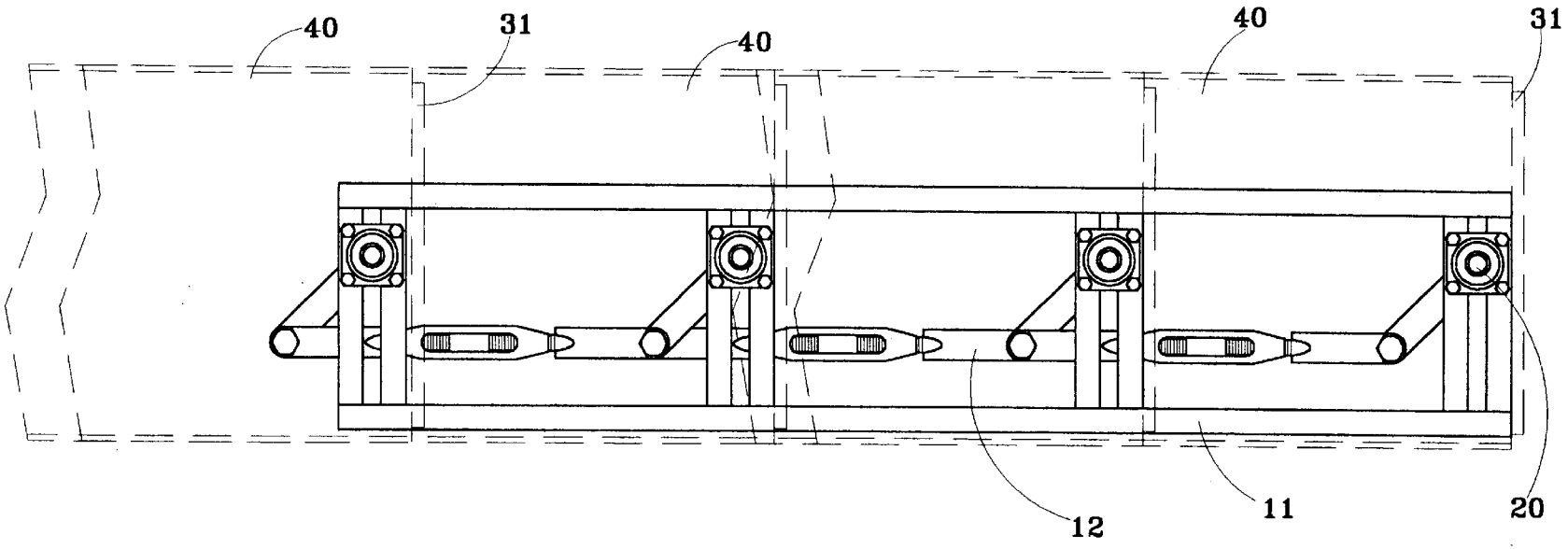
FIG. 4 is a top view of the shielding canopy at the collapsed position.
Figure 5:
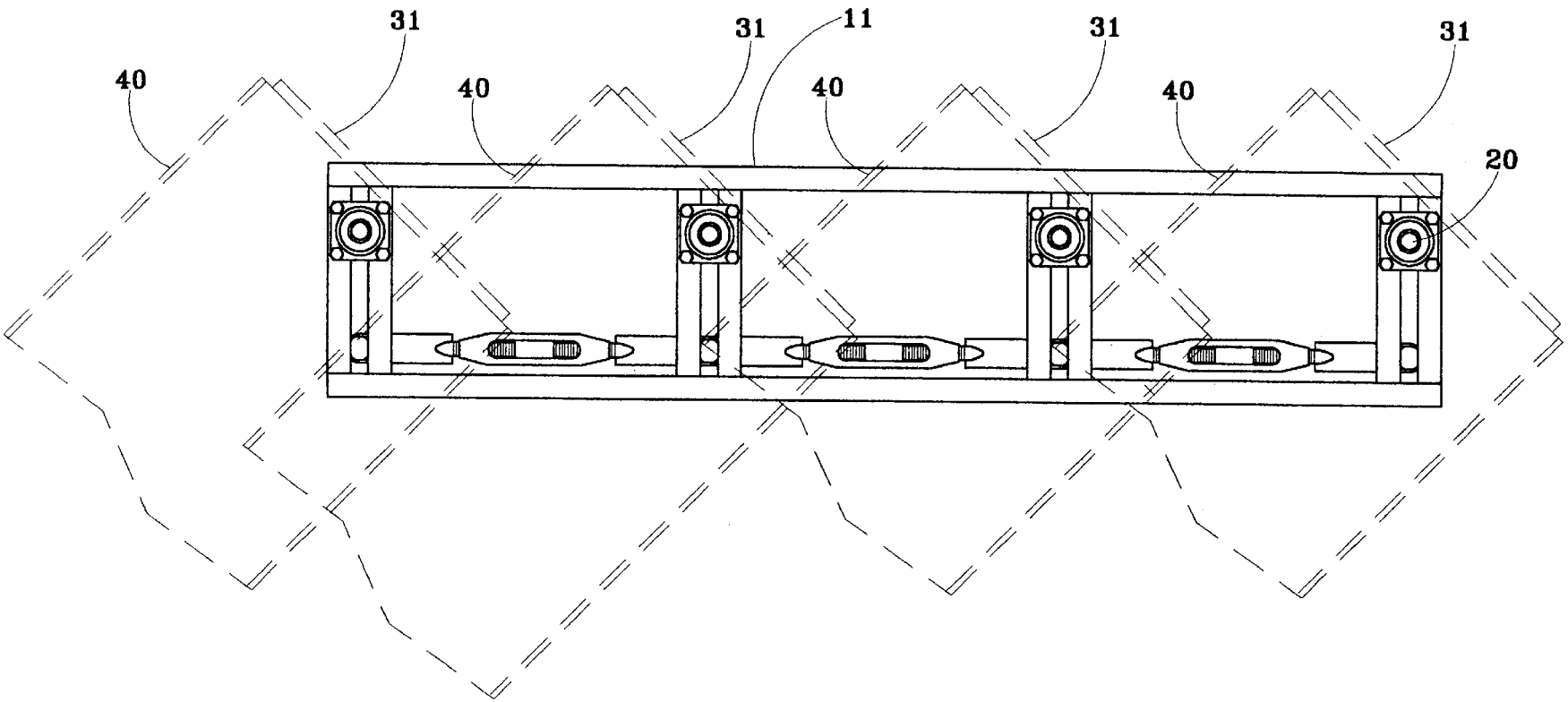
FIG. 5 is similar to FIG. 4 but showing the shielding canopy at a partially expanded position.
Figure 6:
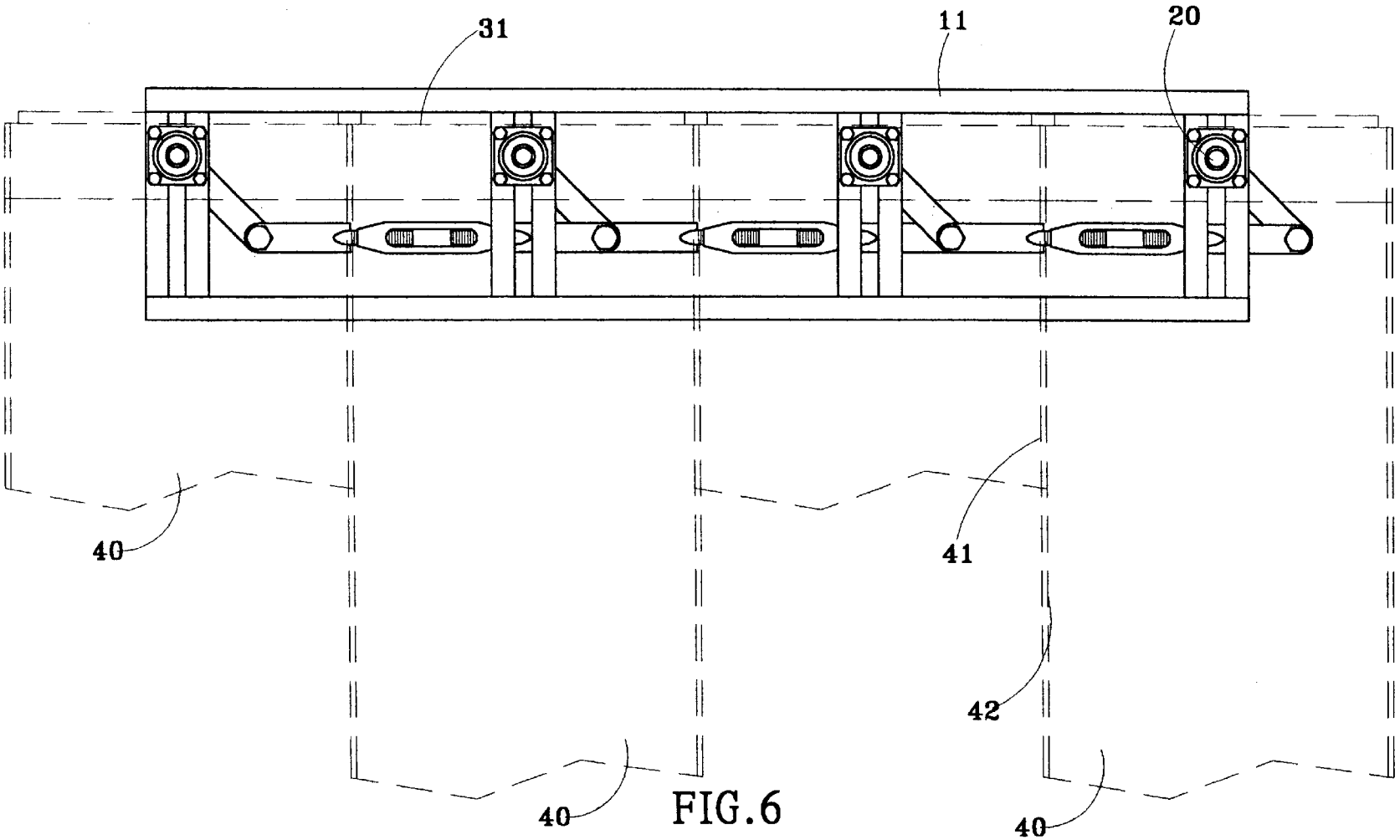
FIG. 6 is similar to FIG. 5 but showing the shielding canopy at a fully expanded position.

When the driving rod 12 is moved, the panels 40 are moved from the collapsed position shown in FIG. 4 to an expanded position shown in FIG. 6 through a partially expanded position shown in FIG. 5. When the driving rod 12 is moved in an opposite direction, the panels 40 move from the expanded position to the collapsed position.

To avoid interference during the movement of the panels 40 between the expanded position and the collapsed position, the edges of each panel 40 extend in opposite directions beyond the support plate 30 and the base section 31 as shown in FIG. 3. The bent flanges 41, 42 are formed on the edges that extend beyond the base section 31 and the support plate 30.

It should be noted that as shown in FIG. 2, when the shielding canopy 10 is collapsed, the panels 40 are positioned to be substantially overlap each other as shown in FIG. 2 for saving space.

If desired, a surface shell (not shown) may be attached to and cover the fixture base 11. Commercial advertisements may be put on the surface shell. The surface shell may be light transmittable and a light source may be provided inside the fixture base 11 for aesthetic or advertising purposes.

Although the present invention has been described with respect to preferred embodiments, it is contemplated that a variety of modifications, variations and substitutions may be done without departing from the scope of the present invention that is intended to be defined by the appended claims.

What is claimed is:

1. A shielding canopy comprising:

a longitudinally extended fixture base;

a plurality of swiveling devices mounted in the fixture base in longitudinally spaced relationship, each swiveling device including a rotating shaft the swivel devices being spaced from each other a predetermined rotatably supported thereon;

a plurality of panels, each of the plurality of panels being attached to an end of a corresponding one of the rotating shafts; and a driving system comprising a driving member movably mounted to the fixture base and coupled to each of the rotating shafts whereby when the driving member is moved, the rotating shafts are rotated to move the plurality of panels between a collapsed position where the panels substantially overlap each other and an expanded position where the panels are positioned side by side to form a canopy.

2. The shielding canopy as claimed in claim 1, wherein each panel is fixed to a support member which is in turn fixed to a corresponding one of the rotating shafts to be rotatable therewith.

3. The shielding canopy as claimed in claim 2, wherein the support member comprises a base section and an arcuate support section, the base section having a socket formed thereon for receiving and fixing the end of the corresponding rotating shaft therein, the arcuate support section having a plurality of holes formed therein for receiving bolts to fix the corresponding panel thereto.

4. The shielding canopy as claimed in claim 1, wherein the fixture base comprises a hollow frame, a light-transmittable surface shell being attached to and covers the hollow frame, light emitting means being arranged inside the fixture base.

5. The shielding canopy as claimed in claim 1, wherein the driving member comprises a flexible endless loop.

6. The shielding canopy as claimed in claim 1, wherein the driving system further comprises a mechanical power source for moving the driving member.

7. The shielding canopy as claimed 1, wherein each swiveling device comprises two shaft bearing elements fixed in the fixture base and spaced from and aligned with each other for rotatably supporting the corresponding rotating shaft.

8. The shielding canopy as claimed in claim 1, wherein a plurality of arms are each pivoted to the driving member, each arm having a free end fixed to the rotating shafts, whereby when the driving member is move the plurality of arms respectively rotate the rotating shafts.

9. The shielding canopy as claimed in claim 3, wherein at least one reinforcing bracket is mounted between the base section and the plate support section of the support member.

10. The shielding canopy as claimed in claim 1, wherein each panel comprises a rigid frame to which a flexible cover is attached.

11. The shielding canopy as claimed in claim 1, wherein each of the panels have a width substantially corresponding to a longitudinal distance between adjacent swiveling devices, whereby when the panels are at the expanded position, edges of adjacent panels engage with each other.

12. The shielding canopy as claimed in claim 11, wherein first and second bent flanges are formed on opposite edges of each panel, the first and second flanges being bent in opposite direction whereby when the panels are at the expanded position, the first and second flanges of adjacent panels engage with each other.

13. The shielding canopy as claimed in claim 2, wherein the panel has a width greater than a width of the support member whereby opposite edges of the panel extend beyond edges of the support member in opposite directions.

14. The shielding canopy as claimed in claim 13, wherein first and second bent flanges are formed on the opposite edges of each panel, the first and second flanges being bent in opposite directions whereby when the panels are at the expanded position, the first and second flanges of adjacent panels engage with each other.

* * * * *